US005701659A

United States Patent [19]

Amano

[11] Patent Number: 5,701,659

[45] Date of Patent: Dec. 30, 1997

[54] METHOD OF MAKING A THIN FILM THERMAL PRINTHEAD

[75] Inventor: Toshio Amano, Kyoto, Japan

[73] Assignee: Rohm Co., Ltd., Koyoto, Japan

[21] Appl. No.: 761,010

[22] Filed: Dec. 5, 1996

Related U.S. Application Data

[62] Division of Ser. No. 254,512, Jun. 6, 1994, abandoned.

[30] Foreign Application Priority Data

Jul. 6, 1993 [JP] Japan ..... 5-167066
Aug. 11, 1993 [JP] Japan ..... 5-199782

[51] Int. Cl.[6] ..... H05B 3/00

[52] U.S. Cl. ..... 29/671; 216/27; 347/201; 451/78

[58] Field of Search ..... 29/611; 347/201; 451/78; 216/27

[56] References Cited

U.S. PATENT DOCUMENTS 3,570,195 3/1971 Otsuka et al. ..... 451/78
3,781,515 12/1973 Morris, Jr. et al. ..... 219/216
4,651,168 3/1987 Terajima et al. ..... 346/76
4,915,718 4/1990 Desai .
4,968,996 11/1990 Ebihara et al. ..... 346/76
5,367,320 11/1994 Taniguchi et al. ..... 29/611

FOREIGN PATENT DOCUMENTS 0398582 11/1990 European Pat. Off. ..... B41J 2/335
0497551 8/1992 European Pat. Off. ..... B41J 2/335

*Primary Examiner*—P. W. Echols
*Attorney, Agent, or Firm*—Michael D. Bednarek; Kilpatrick Stockton LLP

[57] ABSTRACT

A thin film thermal printhead is provided which comprises a head substrate having a first longitudinal edge and a second longitudinal edge, a glaze layer formed on a surface of the head substrate, a patterned resistor layer formed as a thin film on the glaze layer to provide a strip of heating dots extending along the first longitudinal edge of the head substrate, and a patterned conductor layer formed on the resistor layer for selectively supplying power to the heating dots. The glaze layer extends from the first longitudinal edge toward the second longitudinal edge of the head substrate, and has a normal flat surface portion and a rounded marginal surface portion continuous with the normal flat surface. The rounded marginal surface portion extends along the first longitudinal edge of the head substrate and progressively approaches the head substrate toward the first longitudinal edge. The heating dots strip is located at least partially at the rounded marginal surface portion of the glaze layer.

3 Claims, 9 Drawing Sheets

METHOD OF MAKING A THIN FILM THERMAL PRINTHEAD

This application is a division of application Ser. No. 08/254,512 filed Jun. 6, 1994, now abandoned.

BACKGROUND OF THE INVENTION

1. Field of the Invention

This invention relates to a thin film thermal printhead wherein a heating dots strip is provided by a patterned thin layer of resistor material. The present invention also relates to a method of making such a printhead.

2. Description of the Related Art

Thermal printheads are roughly classified into two types which include thick film thermal printheads and thin film thermal printheads.

The thick film thermal printhead utilizes a thick film resistor strip which is formed by screen-printing a resistor paste of e.g. ruthenium oxide on a glazed substrate and thereafter baking the resistor paste for fixation. Such a printhead has been found advantageous in that the formation of the resistor strip can be performed relatively easily, but disadvantageous in the difficulty of increasing the number of heating dots per unit length for increasing the printing resolution of the printhead.

On the other hand, the thin film thermal printhead utilizes a thin film resistor layer of e.g. tantalum nitride formed on a glazed substrate by sputtering for example, and a thin film conductor layer of e.g. aluminum formed on the resistor layer again by sputtering for example, the resistor layer and the conductor layer being patterned by etching to provide a strip of heating dots. Such a thermal head has been found advantageous in the ease of increasing the number of heating dots by sophisticated patterning and the capability of increasing the printing speed, but disadvantageous in the difficulty of performing the manufacturing process as a whole.

As described above, either of the thick film thermal printhead and the thin film thermal printhead has advantages and disadvantages of its own. The present invention concerns the thin film thermal printhead. To describe the problems to be solved by the present invention, reference is now made to FIGS. 20 and 21 which shows a typical prior art thin film thermal printhead.

As shown in FIGS. 20 and 21, the prior art thin film thermal printhead 1 comprises a head substrate 3 having a surface which carries a wider main glaze layer 4a and a narrower partial glaze layer 4b. The main glaze layer 4a covers a major portion of the substrate surface and carries an array of drive ICs (not shown). The partial glaze layer 4b extends along a longitudinal edge of the head substrate 3 adjacent thereto. The respective glaze layers 4a, 4b may be formed by screen-printing a glass paste and thereafter baking the paste for fixation.

A patterned resistor layer 6 is formed on the partial glaze layer 4b and extends partially onto the main glaze layer 4a. The formation of the patterned resistor layer 6 may be made by first forming a uniform layer of e.g. tantalum nitride by sputtering for example, and then etching the layer into a predetermined pattern.

The resistor layer pattern 6 is covered by a similar pattern of conductor layer 5. This conductor layer pattern 5 may be also made by first forming a uniform layer of e.g. aluminum by sputtering for example, and then etching the aluminum layer into a predetermined pattern.

The resistor layer pattern 6 combined with the conductor layer pattern 5 provides a heating dots strip 2 extending on and along the partial glaze layer 4b. The conductor layer pattern 5 and the resistor layer pattern 6 are covered by a protective glass layer 7 which is also formed by sputtering for example.

As described above, the partial glaze layer 4b is provided separately from the main glaze layer 4b, and the heating dots strip 2 is provided on this partial glaze layer. The partial glaze layer 4b has a very small width of about 850 micrometers for example. Thus, when the applied glass paste for the partial glaze layer 4b fluidizes during the baking step after the screen printing, the partial glaze layer 4b tends to arcuately bulge or project due to surface tension (see FIG. 21). Such a partial glaze layer is necessary to make sure that the thermal printhead 1 comes into contact with a recording medium (e.g. paper) at the heating dots strip 2.

However, it has been found that the longitudinal edges of the partial glaze layer 4b are inevitably undulated or waved (see FIG. 20) due to the difficulty of achieving a precise linearity by the screen printing as well as due to unavoidable irregularities in the affinity of the glass paste relative to the head substrate 3. Such waving of the longitudinal edges will inevitably causes undulation or waving at the top face of the partial glaze layer 4b, so that the heating dots strip 2 formed at the top of the partial glaze layer 4b is also undulated or waved, as illustrated in a somewhat exaggerated manner in FIG. 20. The degree of undulation has been confirmed to be 1 micrometer or more per 1 mm longitudinally of the partial glaze layer 4b.

If the recording medium is a flexible sheet such as paper, the above-described undulation of the partial glaze layer 4b causes no deterioration of the printing quality. Since the amplitude of the undulation is only in the order of micrometers, the flexible sheet backed up by a rubber platen (not shown) can easily follow the undulation of the glaze layer 4b or heating dots strip 2 to provide uniform contact longitudinally of the heating dots strip 2.

On the other hand, if the recording medium is a flat surface of a relatively rigid object such as a plastic or metal plate (as used for a credit card, prepaid card, IC card, and etc.), it becomes difficult to bring the undulated or waved heating dots strip 2 into uniform contact with the recording medium longitudinally of the partial glaze layer 4b, consequently deteriorating the printing quality. For instance, the resulting print may be alternately clear and faint longitudinally of the heating dots strip 2.

SUMMARY OF THE INVENTION

It is, therefore, an object of the present invention to provide a thin film thermal printhead which can be conveniently used for printing on a flat surface of a relatively rigid object such as a plastic or metal plate without inviting a deterioration of the printing quality.

The present invention also seeks to provide a method of suitably making such a printhead.

According to one aspect of the present invention, there is provided a thin film thermal printhead comprising: a head substrate having a first longitudinal edge and a second longitudinal edge; a glaze layer formed on a surface of the head substrate; a patterned resistor layer formed as a thin film on the glaze layer to provide a strip of heating dots extending along the first longitudinal edge of the head substrate; and a patterned conductor layer formed on the resistor layer for selectively supplying power to the heating dots; wherein the glaze layer extends from the first longitudinal edge toward second longitudinal edge of the head substrate, the glaze layer having a normal flat surface portion and a rounded marginal surface portion continuous with the normal flat surface, the rounded marginal surface portion extending along the first longitudinal edge of the head substrate and progressively approaching the head substrate toward the first longitudinal edge; and wherein the heating dots strip is located at least partially at the rounded marginal surface portion of the glaze layer.

According to another aspect of the present invention, there is provided a method of making a thin film thermal printhead comprising the steps of: glazing a surface of a head substrate, the head substrate having a first longitudinal edge and a second longitudinal edge; forming a patterned resistor layer as a thin film on the glazed surface of the head substrate to provide a strip of heating dots extending along the first longitudinal edge of the head substrate; and forming a patterned conductor layer on the resistor layer for selectively supplying power to the heating dots; wherein the glazing step comprising applying a glaze layer with a uniform thickness on the surface of the head substrate to extend from the first longitudinal edge toward second longitudinal edge of the head substrate, baking the glaze layer, performing partial material removal of the glaze layer adjacent to the first longitudinal edge of the head substrate, and again baking the glaze layer, whereby the glaze layer is made to have a normal flat surface portion and a rounded marginal surface portion continuous with the normal flat surface, the rounded marginal surface portion extending along the first longitudinal edge of the head substrate and progressively approaching the head substrate toward the first longitudinal edge; and wherein the heating dots strip is located at least partially at the rounded marginal surface portion of the glaze layer.

The head substrate may initially constitute a part of a wider master head substrate which is later divided into a plurality of unit head substrates by cutting at a division line or lines. Therefore, the term "longitudinal edge" should be understood to include not only an actual longitudinal edge of a head substrate (which is initially a unit head substrate) but also a portion of the master head substrate which later becomes a longitudinal edge of each unit head substrate when the master substrate is divided.

In one embodiment of the present invention, the partial material removal of the glaze layer is performed by abrasive blasting. The abrasive blasting may be conducted in a direction perpendicular to the glaze layer to form a stepped marginal portion adjacent to the first longitudinal edge of the head substrate. Alternatively, the abrasive blasting may be conducted in a direction inclined relative to the glaze layer to form an inclined marginal surface adjacent to the first longitudinal edge of the head substrate.

In another embodiment of the present invention, the partial material removal of the glaze layer is performed by cutting with a rotary cutting tool. The rotary cutting tool may be made to perform partial material removal of the glaze layer in such a way as to form an inclined marginal surface adjacent to the first longitudinal edge of the head substrate.

Other objects, features and advantages of the present invention will become apparent from the following detailed description of the preferred embodiments given with reference to the accompanying drawings.

DETAILED DESCRIPTION OF THE PREFERRED EMBODIMENTS

Figure 1:
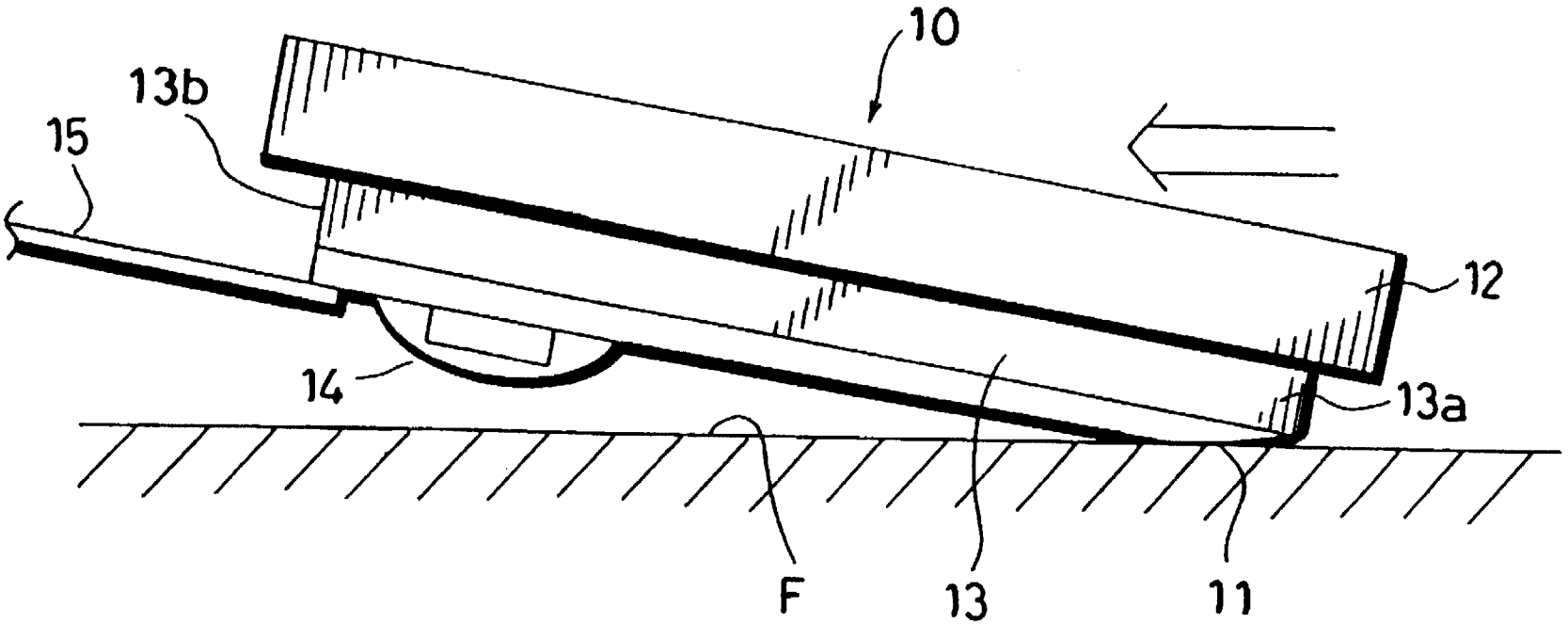
FIG. 1 is a side view showing a thin film thermal printhead according to an embodiment the present invention.

Referring first to FIG. 1 of the accompanying drawings, there is illustrated a thin film thermal printhead embodying the present invention. The printhead, which is generally indicated by reference numeral 10, is designed for conveniently printing on a flat surface F of a recording medium which may be a rigid object such as a plastic or metal plate.

The printhead 10 comprises a heat sink plate 12 made of e.g. aluminum for supporting an elongate unit head substrate 13 which may be made of e.g. a ceramic material such as alumina. The head substrate 13 carries a printing dots strip 11 extending along and adjacent to a first longitudinal edge **13*a* of the substrate 13. The head substrate 13 also carries an array of drive ICs 14 arranged adjacent to the other (second) longitudinal edge 13*b* of the substrate 13. Indicated by reference numeral 15 is a flexible cable for electrically connecting the circuitry of the head substrate 13** to an external circuit (not shown) in a conventional manner.

In use, the printhead 10 is slightly inclined relative to the object surface F with the printing dots strip 11 held against the medium surface F. Such an inclined posture of the printhead 10 is preferred to keep the array of drive ICs 14 out of interference with the medium surface F. Though not illustrated, a thermal transfer ink tape, which is preferably of the sublimation type, is interposed between the printhead 10 and the medium surface F.

Figure 2:
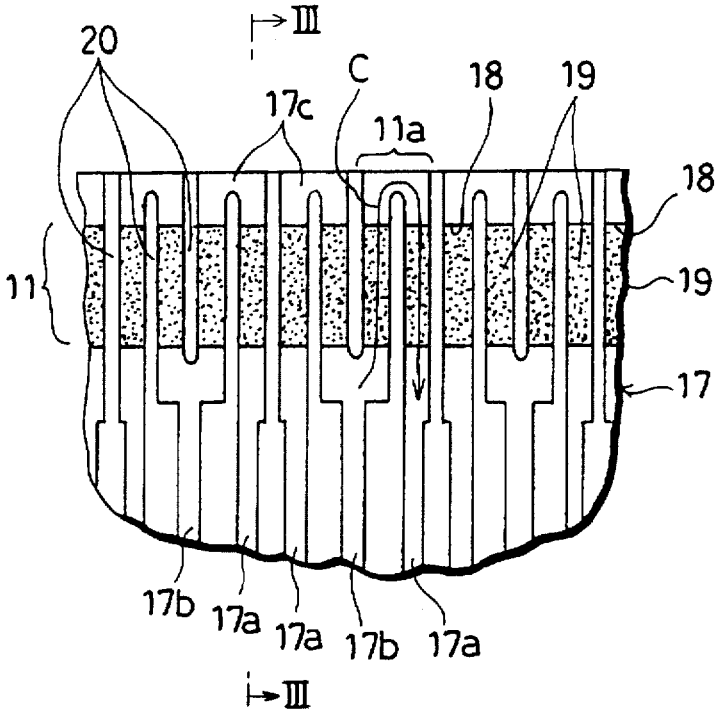
FIG. 2 is a plan view showing a heating dots portion of the same printhead.
Figure 3:
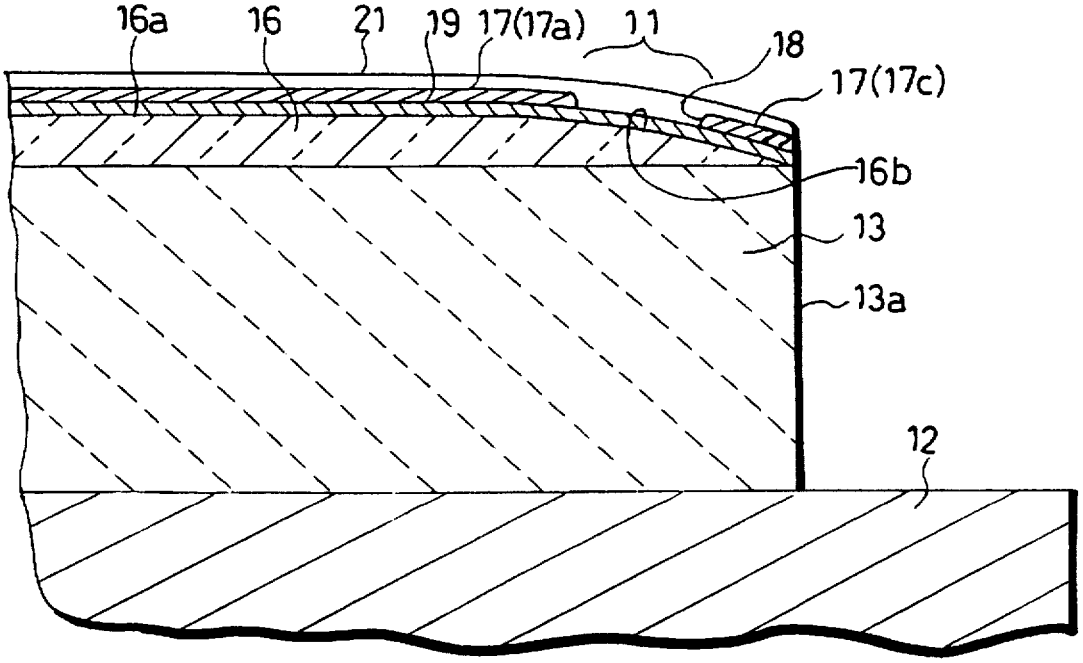
FIG. 3 is a sectional view taken along lines III—III in FIG. 1.

FIGS. 2 and 3 show the details of the structure adjacent to the printing dots strip 11. Specifically, the head substrate 13 has a surface formed with a glass glaze layer 16 substantially over the entire width of the substrate 13. The glaze layer 16 has a normal surface portion **16*a* which is substantially flat, and a marginal surface portion 16*b* which is smoothly continuous with the normal surface portion 16*a* and rounded to progressively approach the surface of the substrate 13 toward the first longitudinal edge 13*a* of the substrate 13**.

Typically, the thickness of the Glaze layer 16 at the normal surface portion **16*a* is 70 micrometers for example. The rounded marginal surface portion 16*b* of the Glaze layer 16** may have a width of 175 micrometers for example.

The normal and marginal surface portions **16*a*, 16*b* of the glaze layer 16** are formed with a pattern of thin resistor layer 19. This resistor layer pattern 19 may be made by first forming a uniform layer of e.g. tantalum nitride by sputtering for example, and then etching the layer into a predetermined pattern. The resistor layer 19 may have a thickness of 0.05–0.15 micrometers for example.

As also shown in FIGS. 2 and 3, the resistor layer pattern 19 is covered by a similar pattern of conductor layer 17. This conductor layer pattern 17 may be made by first forming a uniform layer of e.g. aluminum by sputtering for example, and then etching the aluminum layer into a predetermined pattern. The conductor layer 17 may have a thickness of 1–2 micrometers for example.

Preferably, the etching of the conductor layer 17 is performed together with the etching of the resistor layer 19. In FIG. 2, reference numeral 20 represents slits which are formed by such etching. These slits 20 penetrate not only the conductor layer 17 but also the resistor layer 19. Thus, the resistor layer pattern 19 is similar to the conductor layer pattern 17.

The conductor layer pattern 17 includes a plurality of individual electrodes 17*a* electrically connected to the respective drive ICs 14 (FIG. 1), a plurality of branch electrodes 17*b* electrically branching from a common electrode (not shown), and a plurality of bridges 17*c* electrically associated with the individual electrodes 17*a* and the branch electrodes 17*b*. Further, the conductor layer pattern 17 includes windows 18 along the printing dots strip 11 for partially exposing the resistor layer pattern 19, as shown in FIGS. 2 and 3. The windows 18 may be formed by selectively etching only the conductor layer 17.

When a drive voltage is applied across a selected pair of individual and branch electrodes 17*a*, 17*b*, a drive current passes through a relevant printing dot 11*a*, as indicated by an arrow C in FIG. 2. As a result, a selected printing dot 11*a* generates heat for performing intended printing.

Figure 4:
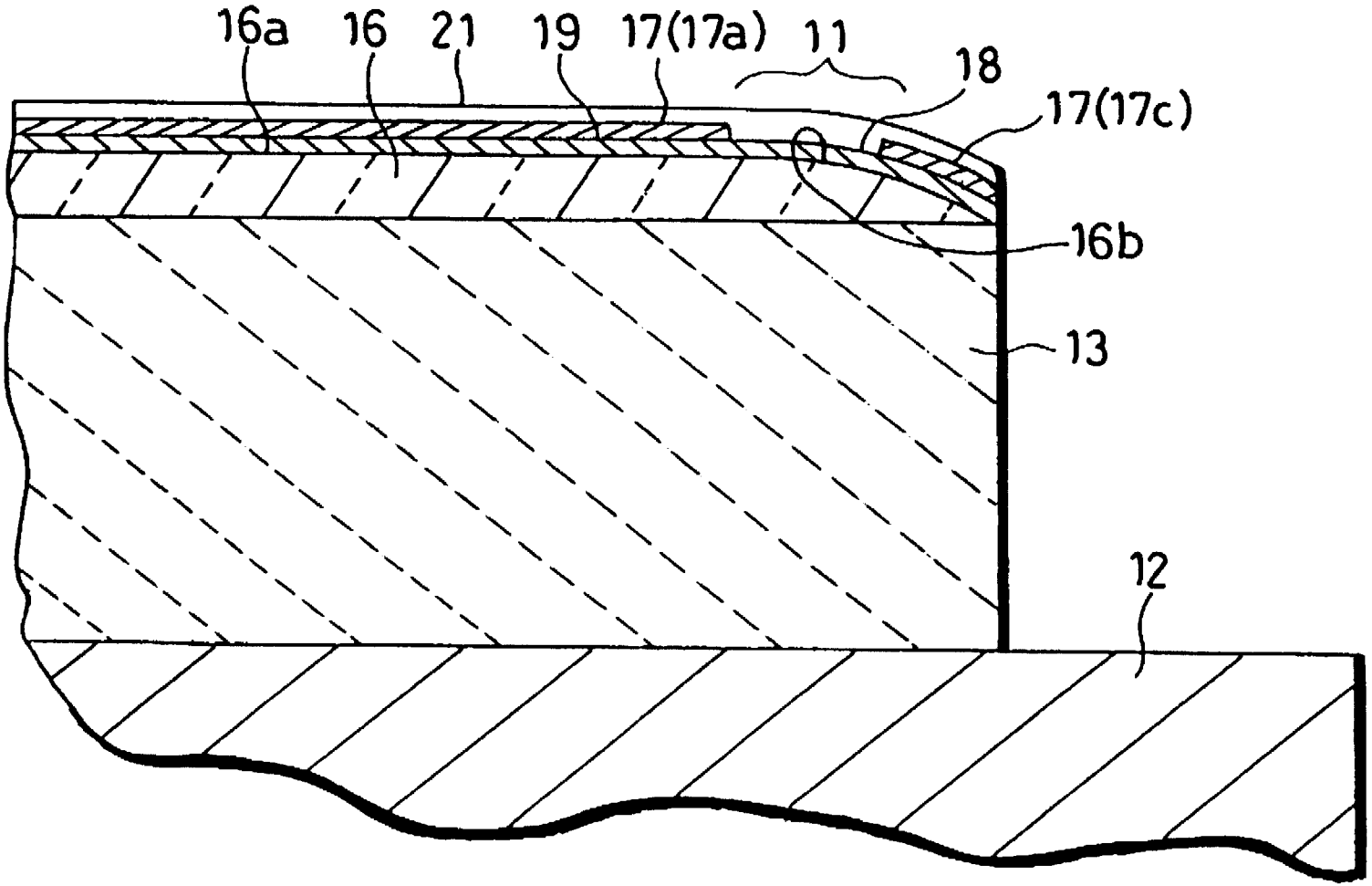
FIG. 4 is a view similar to FIG. 3 but showing a slight modification from the arrangement illustrated in FIG. 3.

As appreciated from FIG. 3, the printing dots strip 11, at which the windows 18 of the conductor layer pattern 17 are formed, may be located entirely at the rounded marginal surface portion 16*b* of the glaze layer 16. Alternatively, the printing dots strip 11 may be located to extend from the normal surface portion 16*a* to rounded marginal surface portion 16*b* of the glaze layer 16, as shown in FIG. 4. In the latter case, the rounded marginal surface portion 16*b* is made to have a smaller curvature.

The conductor layer pattern 17 and the resistor layer pattern 19 are covered by a protective layer 21 which may be made of glass for example, as shown in FIG. 3 or 4. The protective layer 21 has a thickness of e.g. 4–5 micrometers and may be formed by sputtering for example.

Figure 9:
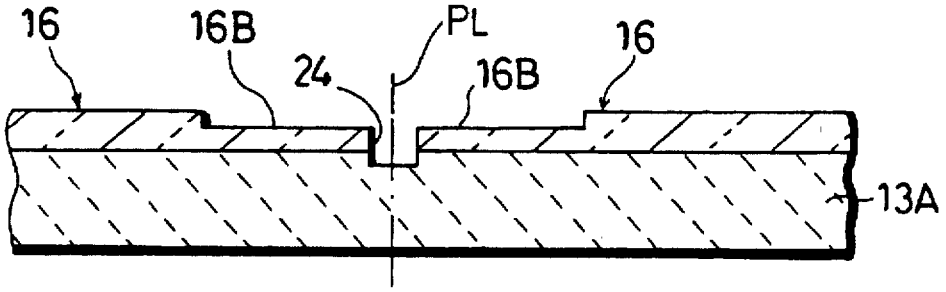
Figure 10:
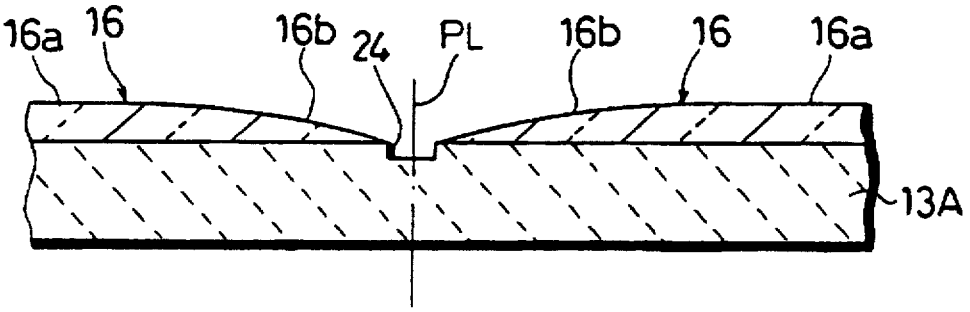
Figure 11:
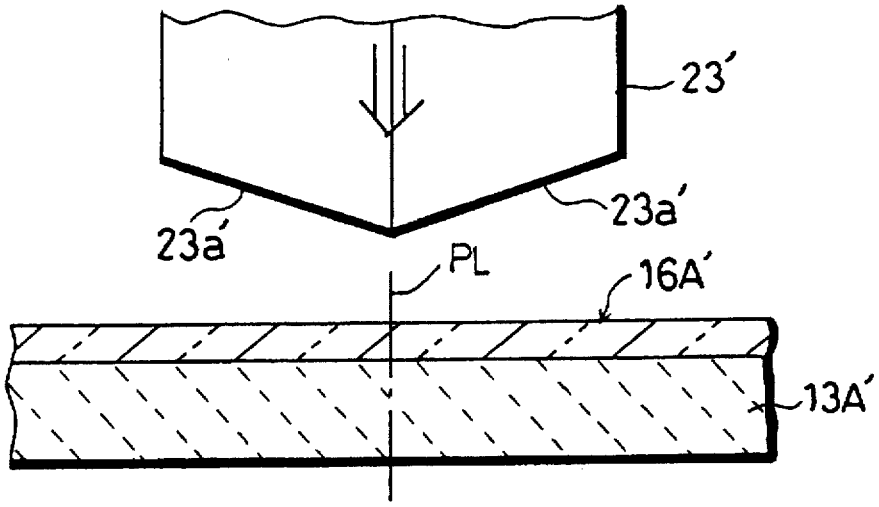
FIGS. 11–13 are sectional views showing successive steps of forming a glaze layer into a predetermined configuration according to a second method embodying the present invention.
Figure 12:
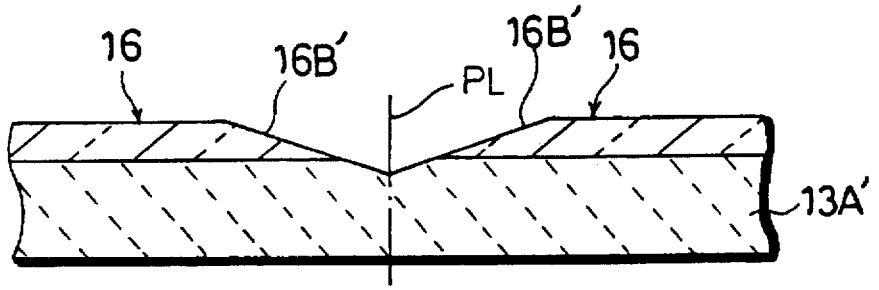
Figure 13:
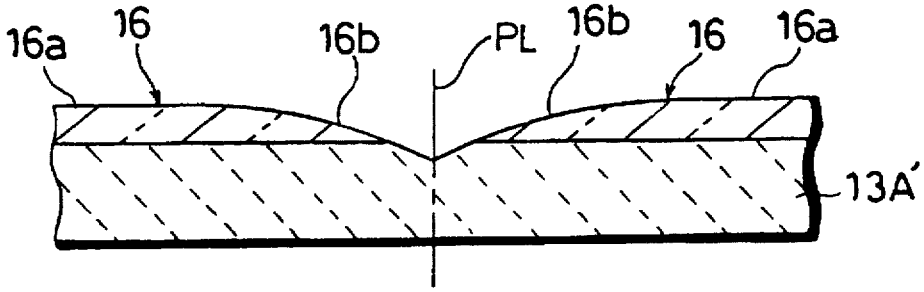

The rounded marginal surface portion 16*b* of the glaze layer 16 may be formed by different methods which includes a first method shown in FIGS. 5 through 10, a second method shown in FIGS. 11 through 13, and a third method shown in FIGS. 14 through 19. Each of these methods is described below.

Figure 5:
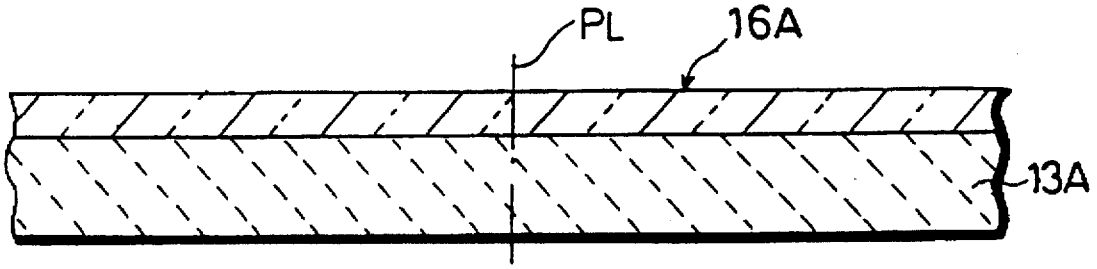
FIGS. 5–10 are sectional views showing successive steps of forming a glaze layer into a predetermined configuration according to a first method embodying the present invention.

According to the first method (FIGS. 1–10), a master glaze layer 16A of a uniform thickness (e.g. 70 micrometers) is first formed on a master substrate 13A by printing and subsequent baking, as shown in FIG. 5. The master substrate 13A is wider than a unit head substrate (element 13 in FIG. 1) and provides a plurality of such unit substrates when divided at each division line PL.

Figure 6:
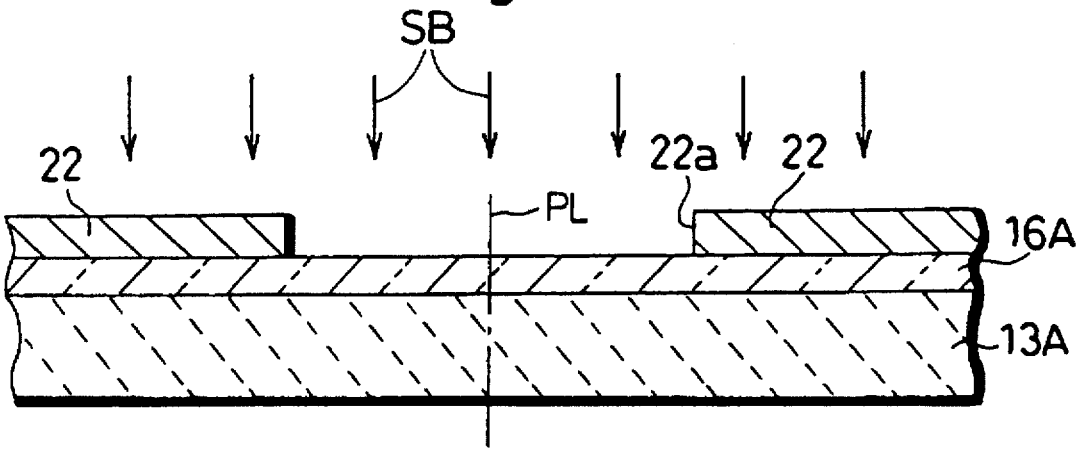
Figure 7:
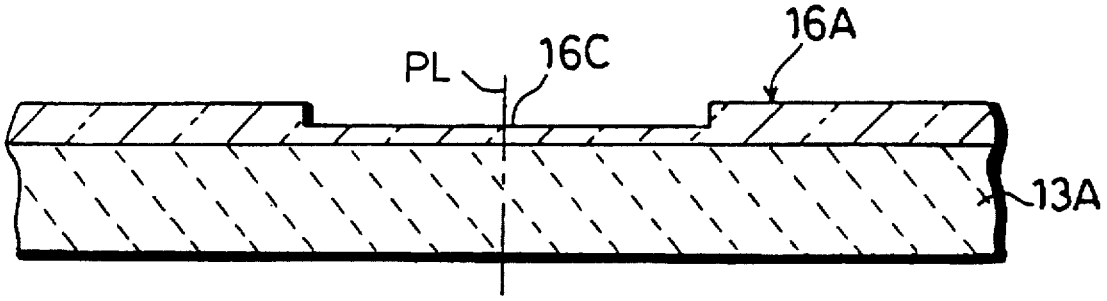

Then, as shown in FIG. 6, a mask 22 having an opening 22*a* at each division line PL is formed on the master glaze layer 16A. In this masked state, the master glaze layer 16A is subjected to abrasive blasting in the perpendicular direction for partial material removal at the opening 22*a* of the mask 22, as indicated by arrows SB. As a result, a shallow groove 16C having a depth of e.g. 50 micrometers is formed in the master glaze layer 16A at the location of the opening 22*a* of the mask 22, as shown in FIG. 7. The depth of the groove 16C may be adjusted by changing the intensity and time of the abrasive blasting SB.

Figure 8:
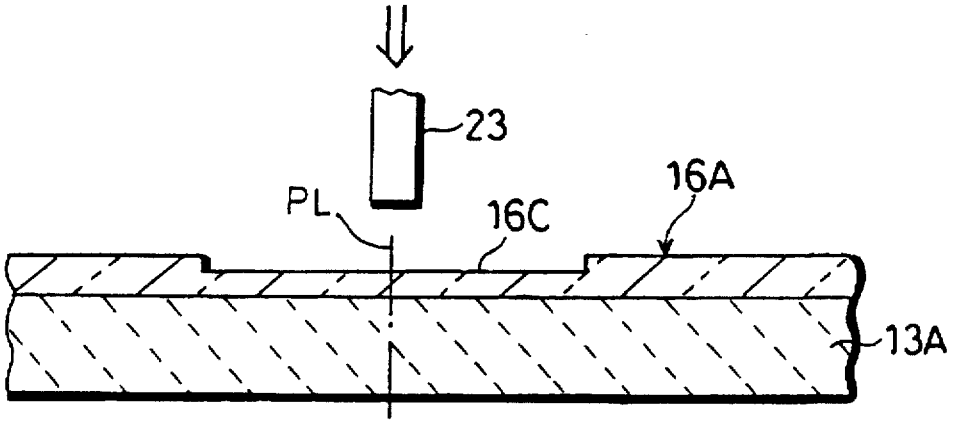

Then, as shown in FIGS. 8 and 9, the master glaze layer 16A is brought into contact with a dicing blade 23 at the division line PL to form a narrower separating groove 24 partially penetrating into the master substrate 13. As a result, the master glaze layer 16A (FIG. 8) is divided into a plurality of unit glaze layers 16 (FIG. 9) each having a stepped portion 16B originating from the shallow groove 16C (FIG. 8) of the master glaze layer. Apparently, each vertical wall of the separating groove 24 corresponds to the first longitudinal edge 13*a* (see FIG. 3) of the head substrate 13.

Then, the unit glaze layers 16 are baked again at a temperature of e.g. 950°–980° C., thereby fluidizing the glaze material (glass). As a result, the stepped portion 16B of each unit glaze layer 16 disappears by melting of the glaze material under surface tension, and the unit glaze layer 16 is made to have a rounded marginal surface portion 16*b* continuous with a normal surface portion 16*a*, as shown in FIG. 10. Such a configuration of the unit glaze layer 16 is fixed upon subsequent curing thereof.

Apparently, the master substrate 13A is cut at the division line PL for division into a plurality of unit head substrates after forming the resistor layer pattern 19 (FIG. 3 or 4), the conductor layer pattern 17 and the protective layer 21, as previously described.

According to the first method described above, the shallow groove 16C (FIG. 7) of the master glaze layer 16A is formed by abrasive blasting SB (FIG. 6). Such abrasive blasting is preferred because of ease in controlling the depth of the shallow groove 16C. However, the shallow groove 16C may also be formed by using a dicing blade (not shown) having a width corresponding to that of the groove.

According to the second method (FIGS. 11–13), a master glaze layer 16A' is first formed, by printing and baking, on a master substrate 13A' and then subjected to material removal at a division line PL by a dicing blade 23' having a pair of inclined faces 23*a*', as shown in FIG. 11. As a result, the master glaze layer 16A' is divided into a plurality of unit glaze layers 16 each having an inclined marginal surface 16B', as shown in FIG. 12. Of course, the dicing blade may be replaced by other rotary cutting tool.

Then, the unit glaze layers 16 are baked again at a temperature of e.g. 950°–980° C., thereby fluidizing the glaze material. As a result, the inclined marginal surface 16B' of each unit glaze layer 16 is converted under surface tension into a rounded marginal surface portion 16*b* continuous with a normal surface portion 16*a*, as shown in FIG. 13. Such a configuration of the unit glaze layer 16 is fixed upon subsequent curing thereof.

Figure 14:
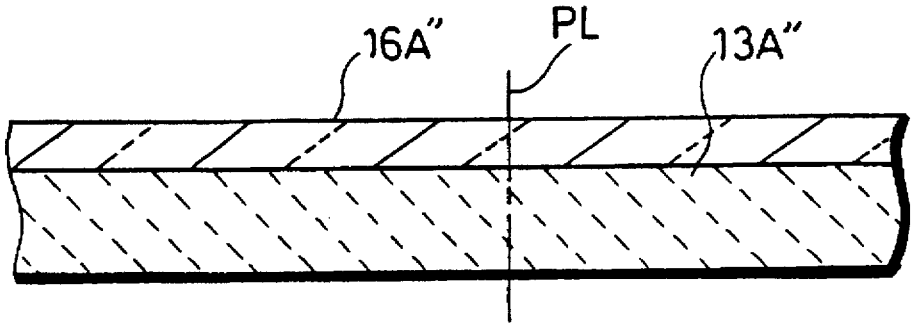
FIGS. 14–19 are sectional views showing successive steps of forming a glaze layer into a predetermined configuration according to a third method embodying the present invention.

According to the third method (FIGS. 14–19), a master glaze layer 16A" of a uniform thickness is first formed on a master substrate 13A" by printing and subsequent baking, as shown in FIG. 14. The master substrate 13A" is wider than a unit substrate and provides a plurality of such unit substrates when divided at each division line PL.

Figure 15:
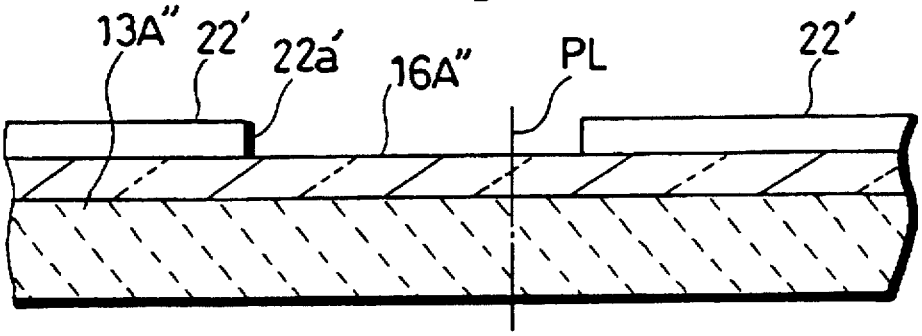

Then, as shown in FIG. 15, a mask 22' having an opening 22*a*' at each division line PL is formed on the master glaze layer 16A". The mask 22' may be made for example by first applying a photosensitive plastic film and then etching the film. The mask 22' may preferably have a thickness of about 100 micrometers for example.

Figure 16:
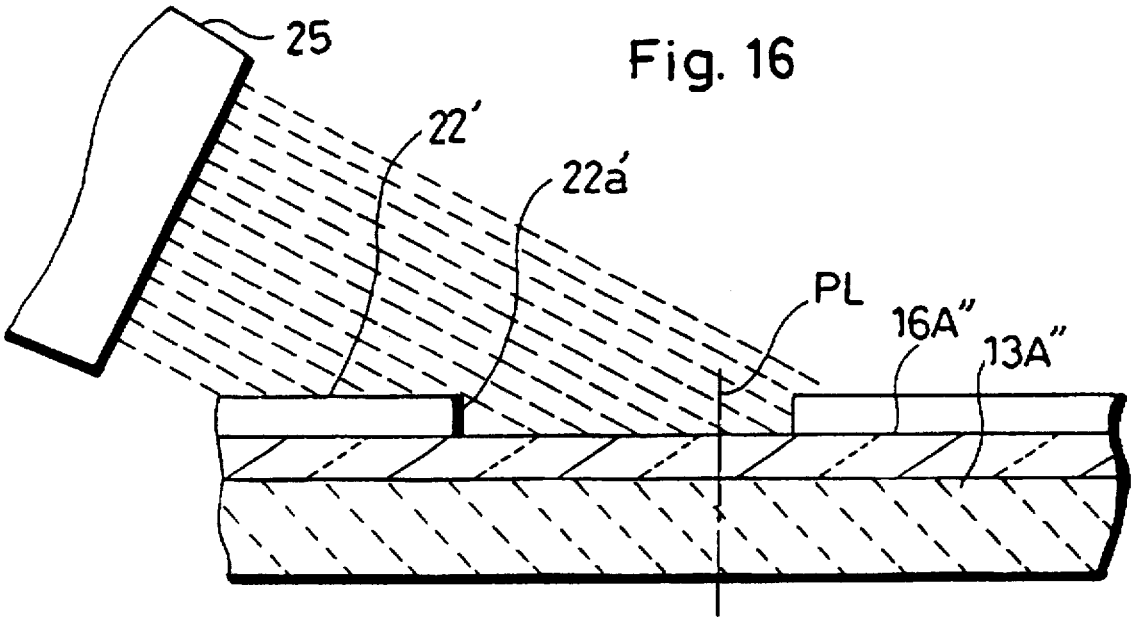

Then, as shown in FIG. 16, the masked master glaze layer 16A" is subjected to oblique abrasive blasting by using a blasting nozzle 25 which is movable along the division line PL. The abrasive blasting is performed by blasting abrasive particles entrained in a high speed air stream. Examples of the abrasive material include particles of e.g. silicon carbide or glass having a 400-mesh grain size for example. The inclination angle of the abrasive blasting relative to the master glaze layer 16A" may be about 30° for example.

Figure 17:
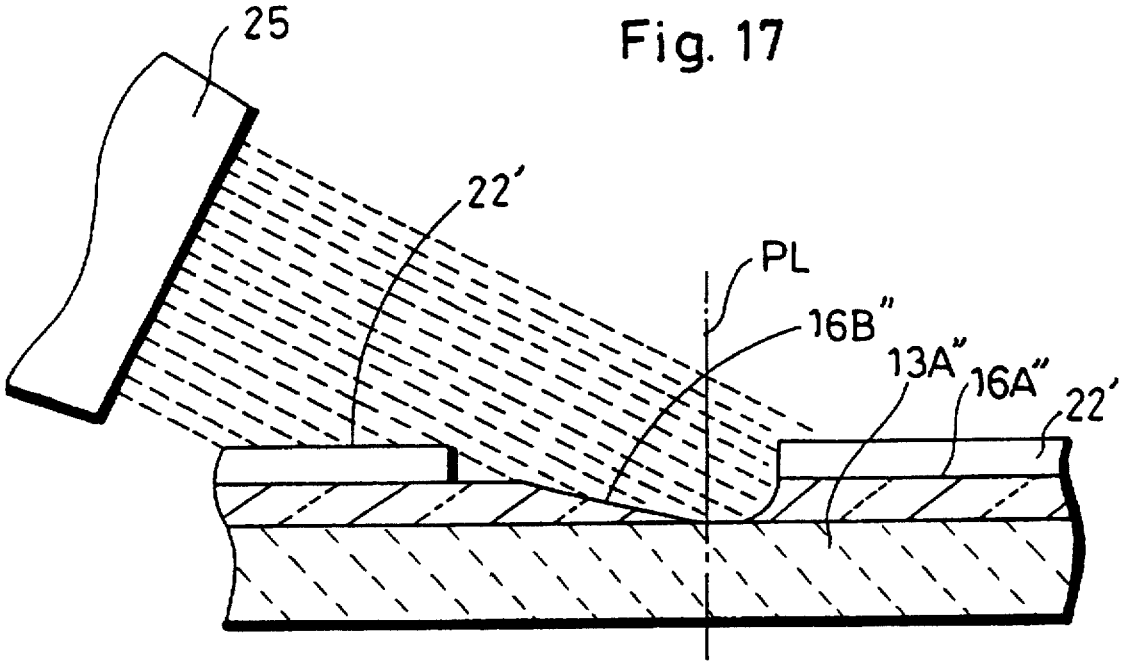
Figure 18:
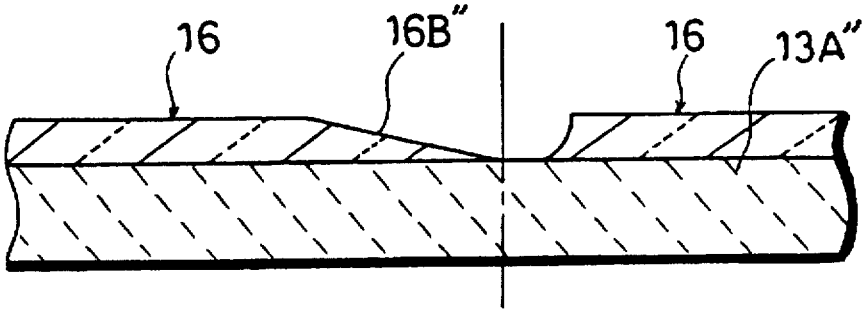

The abrasive blasting causes uniform material removal of the master glaze layer 16A" at the opening **22*a*' of the mask 22', and such material removal is continued until the master substrate 13A" is partially exposed, as shown in FIGS. 17 and 18. As a result, the master glaze layer 16A" is divided into a plurality of unit glaze layers 16 each having an inclined marginal surface 16B". The angle of the inclined marginal surface 16B" may be about 20° for example. It should be appreciated that the right one of the unit glaze layers 16** is made to have a similar inclined marginal surface adjacent to the next division line (not shown).

Figure 19:
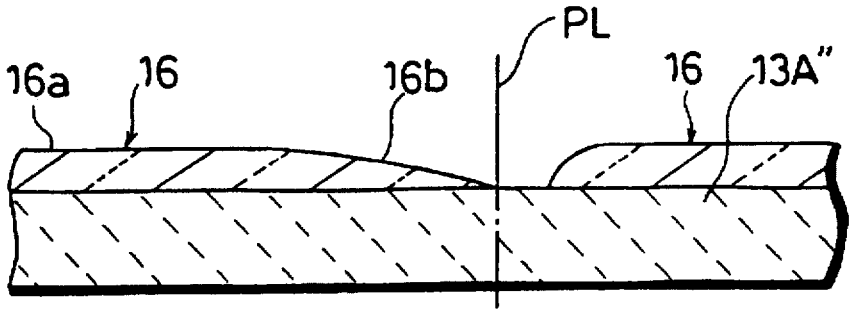

Then, the unit glaze layers 16 are baked again at a temperature of e.g. 950°–980° C., thereby fluidizing the glaze material. As a result, the inclined marginal surface 16B" of each unit glaze layer 16 is converted, by melting under surface tension, to a rounded marginal surface portion **16*b* continuous with a normal surface portion 16*a*, as shown in FIG. 19. Such a configuration of the unit glaze layer 16** is fixed upon subsequent curing thereof.

Apparently, the master substrate 13A" is cut at the division line PL for division into a plurality of unit head substrates after forming the resistor layer pattern 19 (FIG. 3 or 4), the conductor layer pattern 17 and the protective layer 21, as previously described.

Figure 20:
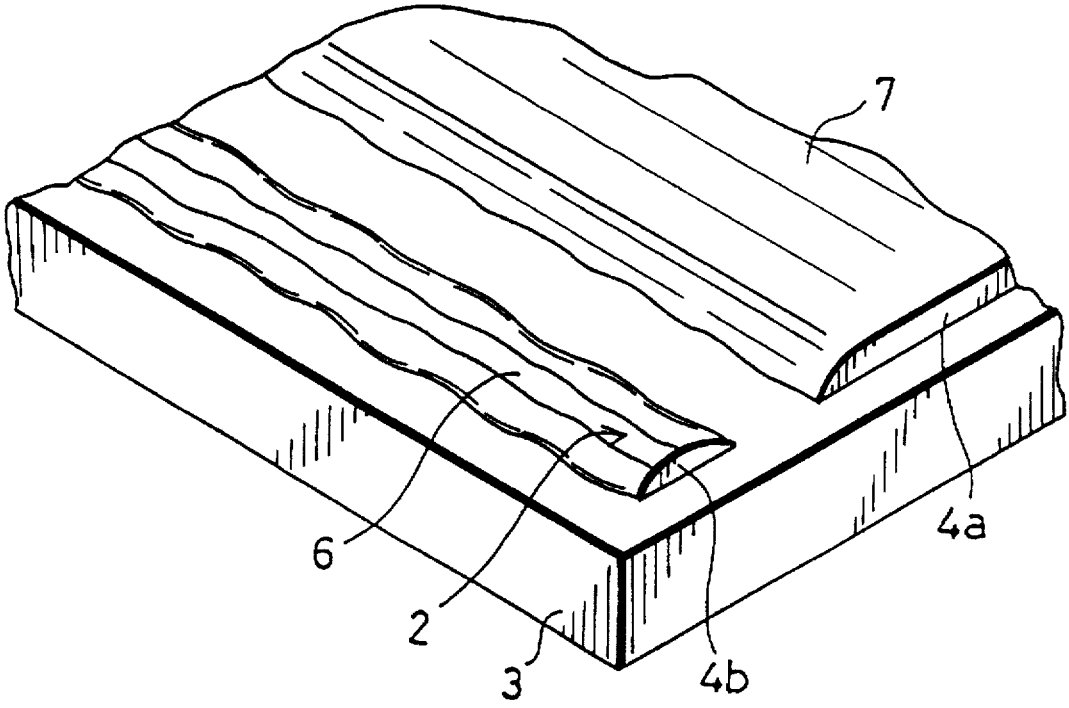
Fig. 20 Prior Art
FIG. 20 is a perspective view showing a prior art thin film thermal printhead.
Figure 21:
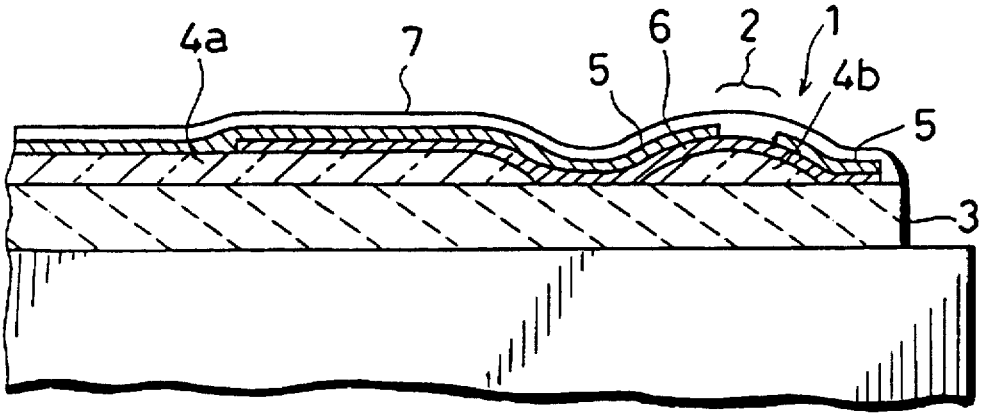
Fig. 21 Prior Art
FIG. 21 is a sectional side view showing the same prior art printhead.

According to any of the first to third methods described above, the rounded marginal surface portion **16*b* of each unit glaze layer 16 is made by the steps of forming a single master glaze layer, performing partial material removal of the master glaze layer adjacent to the division line PL, and performing secondary baking. As opposed to the prior art of FIGS. 20 and 21, the partial material removal of the master glaze layer can be carried out uniformly and accurately at a location where the master glaze layer initially has no edge, and the fluidization of the glaze material in the subsequent secondary baking occurs also uniformly regardless of the affinity of the glaze material relative to the master substrate. Thus, the rounded marginal surface portion 16*b* of the unit glaze layer 16** can be prevented from being undulated in the longitudinal direction.

As previously described, the heating dots strip 11 is located entirely or at least partially at the rounded marginal surface portion **16*b* of the unit glaze layer 16 where high linearity is realized in the longitudinal direction, as shown in FIG. 2 or 3. The heating dots strip 11 can be brought into uniform contact with the flat medium surface F over the entire length of the heating dots strip 11** even if the medium surface F is a surface of a relatively rigid plate such as plastic or metal plate.

According to any of the first to third methods described above, the formation and shaping of a glaze layer is performed collectively with respect to a plurality of unit head substrates by using a larger master head substrate. However, these methods may be also applied individually with respect to separate unit head substrates, in which case each of the unit head substrates may be regarded to have a longitudinal edge at or adjacent to each division line PL (see FIGS. 5–19) of the master head substrate.

The preferred embodiments of the present invention being thus described, it is obvious that the same may be varied in many ways. For instance, the respective thicknesses of the glaze layer 16, resistor layer 19, conductor layer 17 and protective layer 21 may be optionally selected within conventional ranges. Such variations are not to be regarded as a departure from the spirit and scope of the invention, and all such modifications as would be obvious to those skilled in the art are intended to be included within the scope of the following claims.

I claim:

1. A method of making a thin film thermal printhead comprising the steps of:

glazing a surface of a head substrate, the head substrate having a first longitudinal edge and a second longitudinal edge;

forming a patterned resistor layer as a thin film on the glazed surface of the head substrate to provide a strip of heating dots extending along the first longitudinal edge of the head substrate; and forming a patterned conductor layer on the resistor layer for selectively supplying power to the heating dots;

wherein the glazing step comprising applying a glaze layer with a uniform thickness on the surface of the head substrate to extend from the first longitudinal edge toward second longitudinal edge of the head substrate, baking the glaze layer, performing partial material removal of the glaze layer adjacent to the first longitudinal edge of the head substrate, and again baking the glaze layer, whereby the glaze layer is made to have a normal first surface portion and a rounded marginal surface portion continuous with the normal flat surface portion, the rounded marginal surface portion extending along the first longitudinal edge of the head substrate and progressively approaching the head substrate toward the first longitudinal edge;

wherein the heating dots strip is located at least partially at the rounded marginal surface of the glaze layer and wherein the partial material removal of the glaze layer is performed to form a non-inclined stepped marginal portion adjacent to the first longitudinal edge of the head substrate, the stepped marginal portion being later deformed by subsequent baking to provide said rounded marginal surface portion of the glaze layer.

2. The method according to claim 1, wherein the partial material removal of the glaze layer is performed by abrasive blasting.

3. The method according to claim 2, wherein the abrasive blasting is conducted in a direction perpendicular to the glaze layer.

* * * * *